US005081930A

United States Patent [19]

Williams

[11] Patent Number: 5,081,930

[45] Date of Patent: Jan. 21, 1992

[54] GUN PROPELLANT CONTAINING AMMONIUM AZIDE AND AN INERT CASING

[75] Inventor: Laurence O. Williams, Orlando, Fla.

[73] Assignee: Martin Marietta Corporation, Bethesda, Md.

[21] Appl. No.: 492,903

[22] Filed: Mar. 13, 1990

[51] Int. Cl.[5] ..... C06B 45/00; C06D 5/00; C06D 5/06

[52] U.S. Cl. ..... 102/292; 102/282; 102/283

[58] Field of Search ..... 102/292, 282, 283; 149/35; 423/409, 410

[56] References Cited

U.S. PATENT DOCUMENTS 2,981,616 4/1961 Boyer ..... 52/5
3,066,479 12/1962 Koch, Jr. ..... 60/35.4
3,309,248 3/1967 Rausch ..... 149/19
3,898,798 8/1975 Williams ..... 60/207
4,702,167 10/1987 Reinelt et al. ..... 102/282

*Primary Examiner*—Donald P. Walsh
*Assistant Examiner*—Chrisman D. Carroll
*Attorney, Agent, or Firm*—Burns, Doane, Swecker & Mathis

[57] ABSTRACT

A gun propellant comprises ammonium azide in finely divided form and at least one conventional propellant and/or explosive composition. The ammonium azide is free of any heavy metals capable of reacting with the ammonium azide to form metallic azides. The ammonium azide may be in pulverulent form or may be fabricated into a grain having a specific geometry. The ammonium azide may also be employed as a pyrotechnic formulation in a variety of environments.

27 Claims, 2 Drawing Sheets

Fig. 1a
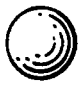
Fig. 1b
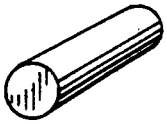
Fig. 1c
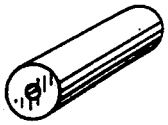
Fig. 1d
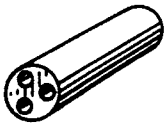
Fig. 1e
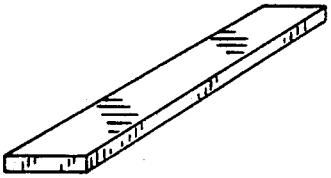
Fig. 1f
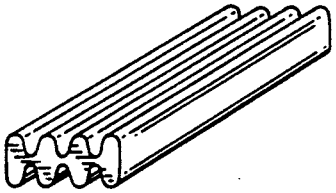
Fig. 1g
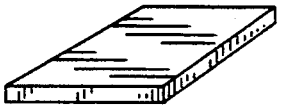
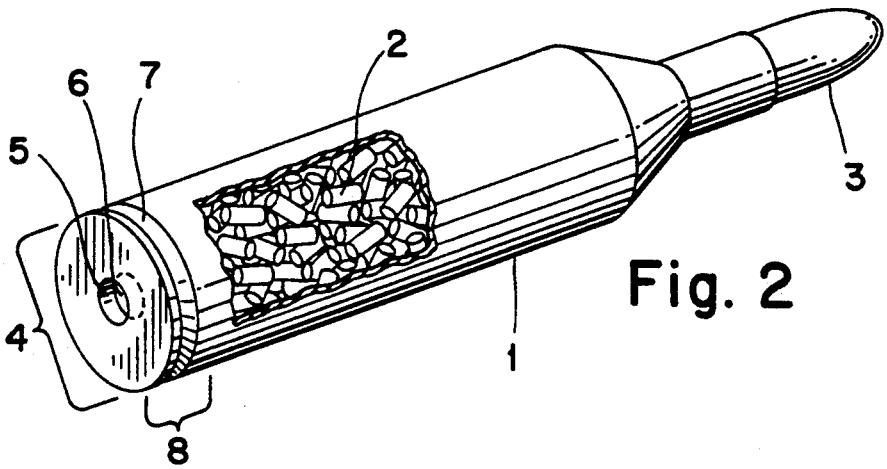
Fig. 2

GUN PROPELLANT CONTAINING AMMONIUM AZIDE AND AN INERT CASING

BACKGROUND OF THE INVENTION

The present invention relates to an improved gun propellant.

Ammonium Azide has been known since its preparation by Curtius in 1890 (T. Curtius, Ber. 23,3023: 1890). Its physical properties are shown in Table I.

| AMMONIUM AZIDE | |
|---|---|
| CHEMICAL FORMULA | $NH_4N_3$ |
| DENSITY | 1.346 GRAMS/cc |
| COLOR & FORM | SOFT WHITE CRYSTALS |
| MELTING POINT | 230°-240° C. |
| HEAT OF FORMATION | +27 KCAL/MOLE |
| VAPOR PRESSURE | 40° C. 3.62 MM HG |
| | 60° C. 6.31 MM HG |
| | 80° C. 36.7 MM HG |
| WATER SOLUBILITY | 20 GRAMS/100 cc @ 20° C. |
| NON HYGROSCOPIC | |
| NON IMPACT SENSITIVE | |

It has been characterized as a material with great sensitivity to explosion by heat and impact. This reputation has inhibited its use in any explosive, propellant or pyrotechnic mixture.

Koch, Jr., U.S. Pat. No. 3,066,479, which discloses a method of stabilizing an azide, which may be ammonium azide, and the resulting composition. The azide of this patent is stabilized by providing an excess of the base forming the basic cation, which, in the case of ammonium azide, is exemplified by anhydrous liquefied ammonia. The resulting azide composition is disclosed as being useful as a fuel gas in rockets, gas turbines or the like.

Rausch et al, U.S. Pat. No. 3,309,248 relates to the use of a mixture which produces solid boron nitride and hydrogen gas, and which is useful as a rocket fuel. The nitrogen oxidizing source material may be either hydrazonium azide or hydrazonium azide hydrazide. This system avoids generation of undesirably high molecular weight gaseous exhaust products, as well as compound dissociation at high temperatures; and Bover, U.S. Pat. No. 2,981,616, which discloses a composition of matter for generating gases, comprising a mixture of an azide which may be ammonium azide and an oxidizing compound.

The high-nitrogen form of nitrocellulose is conventionally used as a gun propellant. Although satisfactory for many applications, there remains a need for gun propellants capable of giving similar propelling capacity at a small charge, and creating a lesser degree of smoke and flash upon exit from the gun bore.

It is a primary object of the present invention to provide a new and improved gun propellant which will be a desirable alternative to conventional nitrocellulose propellants.

It is a further object of the present invention to provide a new and improved gun propellant which will produce no or substantially no flash and smoke upon firing.

SUMMARY OF THE INVENTION

These and other objects according to the present invention are achieved by provision of an improved gun propellant consisting essentially of ammonium azide in finely divided form, preferably, in pulverulent form, or as a grain fabricated to a specific geometry. In another embodiment, the propellant comprises ammonium azide and at least one conventional propellant and/or explosive component.

Moreover, the present invention relates to a method of propelling a projectile comprising igniting an effective amount of such ammonium azide to fire the projectile from a gun at a desired velocity.

Because, as discussed above, ammonium azide is highly reactive with certain metals, ammunition prepared using the propellant according to the present invention must have carefully chosen materials. Accordingly, the present invention is also directed to such ammunition comprising a projectile, a casing for said projectile that is inert with respect to the ammonium azide, and an amount of said ammonium azide effective to propel the projectile at a desired exit velocity. If desired, a primer charge can be incorporated to promote rapid and complete decomposition of the ammonium azide.

The method according to the present invention will comprise rapidly decomposing a charge of the novel propellant in a confined volume having an outlet opening, wherein a projectile is positioned within the volume between the charge and the opening. Suitably, this will be any of a variety of conventional firearms.

BRIEF DESCRIPTIONS OF THE DRAWINGS

FIG. 1 illustrates shapes into which the ammonium azide may be formed;

FIGS. 2-6 illustrates environments in which the propellant may be employed.

DETAILED DESCRIPTION OF PREFERRED EMBODIMENTS ACCORDING TO THE INVENTION

Figure 3:
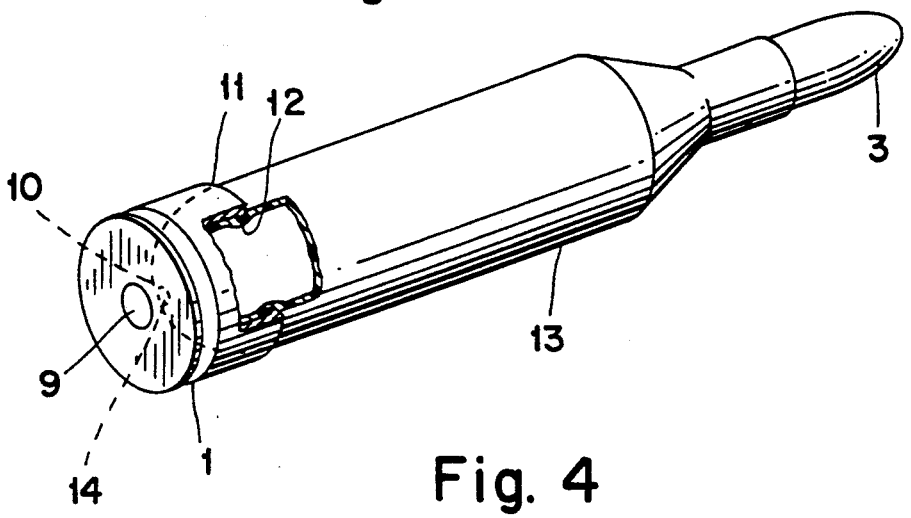

When initiated by an appropriate initiator ammonium azide decomposes to produce an equimolar mixture of hydrogen and nitrogen at 1232 K. This reaction may be illustrated as follows:

$$NH_4N_3\ 2N_2+2H_2 \quad (1)$$

As noted above, however, ammonium azide has not heretofore been used as a gun propellant, because it is commonly believed to be highly impact and friction sensitive.

To the contrary, it has now been discovered that ammonium azide itself is virtually impact insensitive, as tested. The apparent source of these discrepant results is the copper sample containers commonly used to hold material used in explosive testing. We observed that when aluminum sample containers were used, the ammonium azide was devoid of impact sensitivity. Thus, unbeknownst to the art, the source of the erroneously assumed impact sensitivity of ammonium azide was in fact its reactivity with the copper sample containers commonly used in the art, or other heavy metal containers.

In particular, if ammonium azide is prepared substantially free of heavy metal impurities and kept from contact with heavy metals, it is stable to a steel on steel impact as great as 12.2 kilogram meters. This is a very high level of stability. Ammonium perchlorate, an energetic substance used in propellant and explosive formulations, is rated in impact insensitive; but is exploded by impact of 4.7 kilogram meters. The impact insensitivity of ammonium azide extends to a temperature of 160° centigrade, a temperature at which ammonium azide is insensitive to a 12.2 kilogram meters impact, but ammonium perchlorate is exploded by a 1.9 kilogram meter drop.

For the purpose of this discussion heavy metals refers to all metals other than the alkali metals, lithium, sodium, potassium, rubidium and cesium. Heavy metals of particular importance in preparation of pure explosive stable ammonium azide are periodic table column IB elements, copper and silver; column IIB elements, zinc; cadmium and mercury, column IIIA element, thallium; and column IVA element, lead. Sensitivity to the influence of these metals is so extreme that when pure ammonium azide, showing no impact sensitivity in contact with pure aluminum, is tested in contact with copper; it becomes more impact sensitive than ammonium perchlorate.

Pure ammonium azide has been tested in contact with glass at temperatures as high as 300° C. without decomposition. In the range of 300°-350° C. it decomposed quietly without explosion to hydrogen nitrogen and ammonia. The amount of ammonia produced is strongly dependent on the decomposition temperature and pressure.

Thermochemical calculations indicate that the theoretical flame temperature of this reaction is 1232° Kelvin at 1000 psi pressure. Table II shows its gas production as compared to conventional gun propellants.

TABLE II

| | Gas Production by Propellants | | |
|---|---|---|---|
| | Temperature | STP Liters Gas 100 grams | Molecular Weight |
| Nitrocellulose | 2867 | 86.6 | 25.98 |
| Nitrocellulose-Nitroglycerin (60/40) | 3176 | 79.70 | 28.11 |
| Ammonium Azide | 1232 | 148.3 | 15.11 |

As can be seen, the amount of gas produced by the ammonium azide is about twice that produced by the same weight of nitrocellulose. Thus, the propellant according to the present invention is capable of providing the same amount of gas as nitrocellulose using a much smaller charge.

The combination of low temperature, low molecular weight and large gas production potential allows it to be used as a unique gun propellant that produces velocities similar to those produced by current state-of-the-art nitrocellulose propellants, but at a gas temperature 1580° Kelvin lower than nitrocellulose. This property will make it of great value in guns that fire at a rapid rate and suffer from over heating of the barrel with conventional propellants.

With ammonium azide the barrel will suffer almost no heating at rapid firing rates, and barrel life will become enormously longer than is experienced with other propellants.

In addition, the very low temperature of the gas, its lack of carbon compounds, oxygen compounds and water vapor will result in very low muzzle flash, a substantial absence of smoke and virtually no bore erosion.

In particular, unlike conventional nitrocellulose propellants, the ammonium azide propellant according to the present invention has a gun bore exit temperature lower than the auto-ignition temperature of hydrogen (585° C. (1085° F.)). In addition, the gun bore exit temperature of the present propellant is also below the temperature necessary to excite the yellow nitrogen afterglow. This means that the propellant according to the present invention is essentially flashless. Lack of flash will of course be a great advantage respecting concealment of weaponry, and will be especially useful for small arms applications.

A mole of ammonium azide weighs slightly more than 60 grams, and as shown in Equation (1) above, yields 4 moles of gas. This results in a highly advantageous ratio of volume of propulsion gas generated to weight of propellant charge, as will be demonstrated hereinafter. Specifically, and again with reference to conventional nitrocellulose propellant, it would be necessary to use approximately 50% more charge, by weight, to generated the same volume of gas as a given charge of the propellant according to the present invention.

Also evident from the above equation (1) is that the reaction converts a solid to two gases, with no particulate matter generated as a reaction by-product. Absence of particulate matter in the propellant gas is another factor relating to decreased gun bore erosion. Presence of oxygen in the propellant gas tends to accelerate gun bore erosion, and, as shown above, the propellant according to the present invention generates no oxygen.

Many gas generator propellant applications require a gas of low temperature and low molecular weight. Ammonium azide can be used in a pure form or formulated with other ingredients to provide gas generator propellants of unique low temperature and low molecular weight.

For example, ammonium azide can be added to conventional propellant and/or explosive formulations to increase the hydrogen and nitrogen content of the exhaust gas and decrease its molecular weight. It can also be utilized in igniter formulations to effect their gas composition.

For the use of pure ammonium azide as a low temperature gun propellant it will be shaped by conventional methods such as pressure, extrusion, or molding, or the like into any desired shape, such as flakes, stripe plates, cylinders, or spheres. These shapes will be fabricated with or without perforations. These shapes will allow control of the deflagration rate of the ammonium azide in a manner similar to that obtained with current gun propellants.

The deflagration rate may also be controlled by the addition of catalysts. The heavy metals capable of causing impact sensitivity can be utilized in carefully controlled low concentrations to catalyze the deflagration rate.

When subjected to pressure ammonium azide is consolidated into a solid, crystal clear, water white mass. The physical properties of this consolidated material may be adequate for many propellant applications. For other applications it may be necessary to add small quantities of other materials to modify the physical properties. Surface coatings may be used to control the volatilization rate of the ammonium azide.

Accordingly, when it is said that a preferred embodiment of the propellant composition according to the present invention "consists essentially of" ammonium azide in finely divided form, it is meant that the composition is substantially free of ingredients that would react with ammonium azide to form other than gaseous reaction products. For example, in the Bover patent discussed above, reaction of azide with peroxide generates solid sodium monoxide or barium oxide.

It is preferred that the propellant according to the present invention be prepared starting from pure ammonium azide, which has the form of platelet-like crystals. The pure ammonium azide is then finely divided, in an effective manner, preferably by pulverization, to provide a product having as high and uniform a surface area as possible. A high surface area for the inventive propellant will promote rapid and complete decomposition of the compound, and, in turn, improved firing of the projectile.

Ammonium azide, shaped as described above, into propellant grains. Typical shapes are as shown in FIG. 1*a* (spherical); 1*b* (cylindrical); 1*c* (cylindrical with perforation); 1*d* cylindrical with multi perforations); 1*e* (strips); 1*f* (contoured strips); and 1*g* (plate). These grains ("2" in FIG. 2) can be loaded into standard designed cartridge cases as shown in FIG. 2. These grains may be coated to prevent escape of the ammonium azide from the individual grain or the cartridge may be hermetically sealed to prevent the escape of ammonium azide vapor from the cartridge.

The construction material of the case ("1" in FIG. 2) should be made of a substance which substantially free of the heavy metals to prevent the occurrence of shock sensitivity in the finished cartridge. Although any metal which meets the above criteria can be employed, stainless steel and aluminum are preferred metals for the fabrication of cartridges. Moreover, as a result of the very low reaction temperature of ammonium azide and the absence of oxygen containing compounds cartridge cases may be fabricated from certain types of plastics.

The base of a cartridge case 4 must perform the function of sealing the high pressure gas against escape from the barre past the barrel closure. To perform this obturation function the head of the case should possess considerable physical strength. When plastics are employed, this may be obtained by selection of strong plastics, or plastics reinforced with strong filament materials such a graphite fibers, Kelvar, boron fibers or similar materials. The base 4 will also contain the primer 5 and the extractor groove 7.

The base of the plastic case may also be supported by a metal support. The interior of the metal base will be contoured to fit and support the plastic case holding the ammonium azide charge and the exterior contoured to fit the chamber closure face and extraction groove. Such a configuration is illustrated in FIG. 3. In FIG. 3, the metallic base will contain the primer pocket 9, the extraction groove, the shoulder for establishing head space 11 and a lip 12 that will engage the plastic cartridge case charge holder 13 allowing it to be extracted from the gun chamber when expended.

The primer pocket 9 will hold a standard configuration primer optimized for the ignition of ammonium azide propellant. The primer pocket will communicate with the charge through the primer charge flash tube 14 in the metallic base. The plastic cartridge case charge holder will be fabricated with a thin area 10 that lines up with the primer charge flash tube. On firing the hot gas from the primer will break through the thin portion of the plastic cartridge case charge holder and ignite the ammonium azide.

The cartridge case types shown in FIGS. 2 and 3 would be suitable for any type of gun that utilizes a cartridge case containing primer propellant charge and projectile (3 in FIG. 2, and 3 in FIG. 3) assembled, as a single unit. For larger caliber guns where, for handling purposes, it is desirable to have a charge holder separate from the projectile the same type of design practices would be followed as in the smaller caliber cartridge cases.

Figure 4:
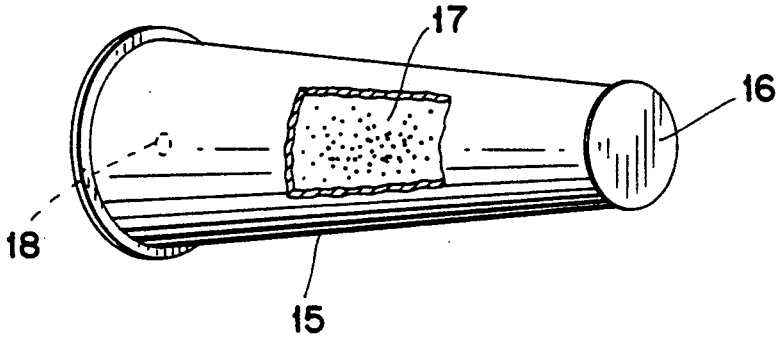

For example, the charge holder 15 can be made entirely of a compatible material and sealed with a plug 16 of compatible material and having a base with a charge with a primer pocket 18 as illustrated by FIG. 4. As is standard practice with this type of ammunition the sealing plug 16 is designed strong enough to prevent accidental puncture, but weak enough that when the charge 17 is fired it will break away allowing the expanding propellant gas to accelerate the projectile.

For the very largest guns for which the propellant is handled in bags, ammonium azide can also be handled in bags. Because of its volatility and water solubility the bags should be gas tight. This can be achieved by, for example, lining current propellant bags with a thin plastic membrane or by making the bags from a plastic film material. Examples of such molded bags are shown in FIG. 5.

Figure 5A:
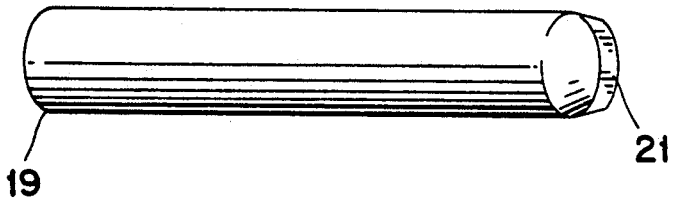
Figure 5B:
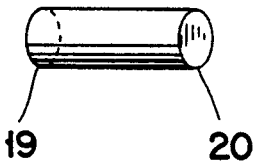

In FIGS. 5*a* and 5*b* the bags are shown as a plastic film tube with a heat sealed bottom 19 and top 20 or with one end crimp sealed 21. Either type of seal would be suitable. The bag material can be any type of compatible plastic such as polyethylene, polypropylene, polytetrafluoroethylene, polyvinylchloride, polyester or cellulose. In practice it would be desirable to avoid bags made from plastics containing fluorine or chlorine inasmuchas on firing, acids would be produced that would have a detrimental effect on gun bore life.

The plastic bags should be made as thin and light weight as is consistent with the desired handling characteristics because the bag material will react with the high temperature propellant gas, on firing, and will slightly reduce the propellant performance. The size of the bag is not critical and for example can vary from 0.2 in diameter in FIG. 5B to 5–16 in or even larger as illustrated in FIG. 5A

In all these applications it will be necessary to ensure that the ammonium azide vapor does not contact the primer formulation. This is required because over a period of time the ammonium azide vapor will react with the primer composition changing its behavior. Isolation can be obtained in cartridges fabricated as shown in FIG. 2 by placing a small thin disk of a compatible material 6 in the bottom of the primer pocket and seating the primer firmly against it to effect a seal. Materials such as aluminum foil or polypropylene film are preferred barriers but any other compatible materials can be employed. For the supported cartridge case shown in FIG. 3 the plastic charge holding cartridge case will isolate the ammonium azide from the primer. For the separate loaded cartridge a vapor barrier similar to that used with the FIG. 2 cartridge can be employed. For bag loaded guns the ammonium azide is isolated by the bag and cannot contact the primer.

Figure 6:
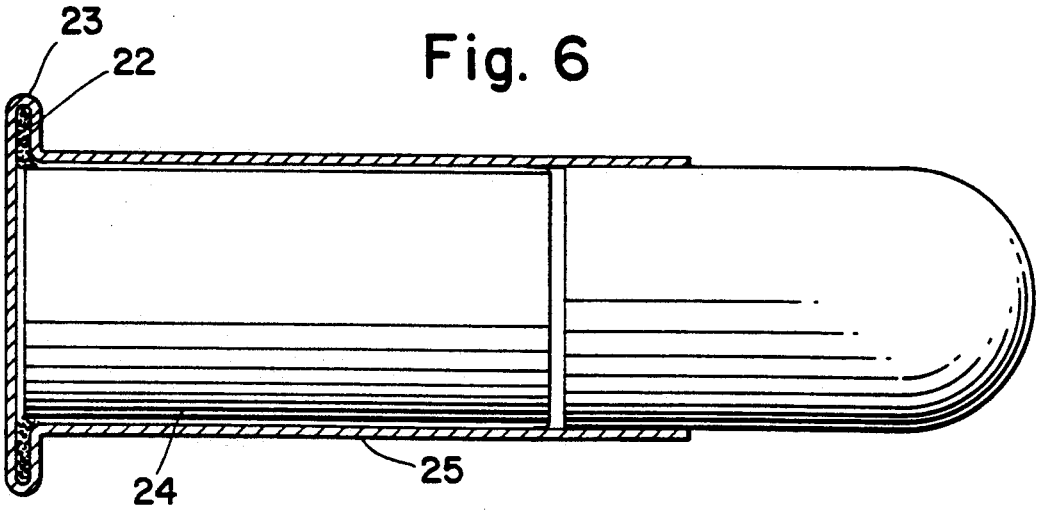

Rim fire cartridge cases as illustrated in FIG. 6 will require special treatment since the primer material 22 is crimped into the edge of the rim 23. This type of cartridge has no convenient position to place a vapor barrier. To allow the use of ammonium azide propellant in the bag 24 technique utilized with the very largest guns can be used. A bag such as shown in FIGS. 5 and 6 can be charged with ammonium azide and slipped into the cartridge case 25.

Ammonium azide of controlled purity can be utilized in all types of guns to provide performance similar to current propellants but with a reaction temperature more than 1500° K. cooler. This very low reaction temperature will result in much longer bursts of fire from rapid fire weapons and greatly extended bore life for all weapons. While providing these advantages it will also produce very little flash and no smoke.

An application for which the propellants according to the present invention are envisioned as being especially useful is in high rate of fire guns such as are used on aircraft and for anti-aircraft and anti-missile defense. In these weapons the high rate of fire causes an extreme barrel heating load, resulting in high erosion and short barrel life. The low temperature and erosion potential of the ammonium azide propellants according to the present invention will greatly lengthen the life of these high rate of fire weapons, providing both a cost and tactical advantage.

In order to illustrate the present invention and the advantages associated therewith, the following examples are given, it being understood that the same are intended solely as illustrative and no ways limitive.

EXAMPLES

Example 1

This example illustrates the performance of ammonium azide compared to nitrocellulose for three types of standard guns.

TABLE III

Comparative Gun Performance
NC = Nitrocellulose with T = 2867° K.
AA = Ammonium Azide with T = 1232° K.

| | Propellant | Projectile Weight | Charge Weight | Barrel Length | Velocity ft/sec |
|---|---|---|---|---|---|
| 30-06 | NC | 180 gr | 50 gr | 24 in | 2450 |
| Rifle | AA | 180 gr | 50 gr | 24 in | 2000 |
| 222 | NC | 50 gr | 20 gr | 24 in | 2770 |
| Rifle | AA | 50 gr | 20 gr | 24 in | 2240 |
| 105 mm | NC | 30 lbs | 12 lbs | 17.5 ft | 3460 |
| Cannon | AA | 30 lbs | 12 lbs | 17.5 ft | 2770 |

gr = grains,
in = inches,
lbs = pounds,
ft = feet,
sec = seconds

Although the present invention has been described with reference to various preferred embodiments thereof, it will be appreciated that this has been done solely by way of illustration, and is not intended to limit the invention in any way. Instead, it is intended that the invention be construed within the full scope and spirit of the appended claims.

What is claimed is:

1. A gun propellant comprising ammonium azide in finely divided form and at least one conventional propellant and/or explosive composition in a casing having a surface in contact with the ammonium azide that is inert to said ammonium azide.

2. A gun propellant consisting essentially of ammonium azide in finely divided form in a casing having a surface in contact with the ammonium azide that is inert to said ammonium azide.

3. The gun propellant according to claim 1, wherein said ammonium azide is free of heavy metals capable of reacting with ammonium azide to form metallic azides.

4. The gun propellant according to claim 2, wherein said ammonium azide is free of heavy metals capable of reacting with ammonium azide to form metallic azides.

5. The gun propellant according to claim 1, wherein said ammonium azide is in pulverulent form.

6. The gun propellant according to claim 1 wherein said ammonium azide has been formed into propellant grains having a predetermined size and shape.

7. The gun propellant according to claim 2, wherein said ammonium azide is in pulverulent form.

8. The gun propellant according to claim 2 wherein said ammonium azide has been formed into propellant grains having a predetermined size and shape.

9. The gun propellant according to claim 1, further comprising an additional material which is effective in altering the deflagration rate of ammonium azide.

10. The gun propellant according to claim 2, further comprising an additional material which is effective in altering the deflagration rate of ammonium azide.

11. The gun propellant according to claim 1, further comprising a minor amount of an additional material which is effective in altering the physical properties of ammonium azide.

12. The gun propellant according to claim 2, further comprising a minor amount of an additional material which is effective in altering the physical properties of ammonium azide.

13. The gun propellant according to claim 6, further comprising a surface coating which is effective in controlling volatilization of the ammonium azide.

14. The gun propellant according to claim 8, further comprising a surface coating which is effective in controlling volatilization of the ammonium azide.

15. An article of ammunition, comprising a projectile, an amount of propellant consisting essentially of ammonium azide effective to propel said projectile at a predetermined velocity, and a casing confining said propellant adjacent said projectile, said casing having a surface contacting said propellant that is inert with respect to said propellant.

16. An article of ammunition according to claim 15, wherein said casing comprises a plastic lining providing said inert surface.

17. An article according to claim 15, wherein said inert surface is aluminum.

18. An article according to claim 15, further comprising a percussion cap and a primer composition disposed between said percussion cap and said propellant.

19. An article according to claim 18, wherein said primer composition contains a material capable of accelerating the decomposition of ammonium azide.

20. An article according to claim 19, wherein said accelerator is a metal or metal salt comprising copper, silver mercury lead or cadmium.

21. An article according to claim 18, further comprising a heat- and pressure-degradable membrane interposed between said primer composition and said propellant.

22. An article according to claim 15, wherein said casing comprises a cartridge which can be employed with a cartridge firing weapon.

23. An article according to claim 15, wherein said casing comprises a bag which can be employed in rim fire cartridges.

24. An article according to claim 15, wherein said casing comprises a bag which can be employed in large caliber guns.

25. An article according to claim 15, wherein the propellant is employed in weapons that have a high rate of fire.

26. A method of propelling a projectile, comprising rapidly decomposing a charge of a propellant according to claim 1 in a confined volume having an outlet opening, wherein a projectile is positioned within said volume between said charge and said opening.

27. A method of propelling a projectile comprising rapidly decomposing a charge of a propellant consisting essentially of ammonium azide which is in a casing having a surface in contact with said propellant that is inert to said propellant; and a confined volume having an outlet opening, wherein a projectile is positioned within said volume between said charge and said opening.

* * * * *